US006382992B1

(12) United States Patent
Bouchan et al.

(10) Patent No.: US 6,382,992 B1
(45) Date of Patent: May 7, 2002

(54) ELECTRICAL CONNECTOR ASSEMBLY WITH IMPROVED CAMMING SYSTEM

(75) Inventors: Christophe Bouchan, Lonjumeau; Patrick Dechelette, Les Plessis Robinson, both of (FR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/708,991

(22) Filed: Nov. 8, 2000

(30) Foreign Application Priority Data

Nov. 10, 1999 (EP) ..... 99 122 426
Nov. 30, 1999 (EP) ..... 99 123 742

(51) Int. Cl.[7] ..... H01R 13/62
(52) U.S. Cl. ..... 439/157; 439/347
(58) Field of Search ..... 439/157, 347

(56) References Cited

U.S. PATENT DOCUMENTS 5,169,327 A * 12/1992 Hatagishi ..... 439/157
5,320,544 A * 6/1994 Naoto et al. ..... 439/157
5,575,676 A * 11/1996 Tsukakoshi et al. ..... 439/157
5,876,226 A 3/1999 Tsukakoshi et al. ..... 439/157
5,888,080 A * 3/1999 Maejima ..... 439/157
5,899,762 A 5/1999 Ainceri ..... 439/157
5,928,013 A * 7/1999 Iwahori ..... 439/157
5,938,483 A 8/1999 Zweigle et al. ..... 439/752
5,957,709 A 9/1999 Heimueller et al. ..... 439/157
5,997,322 A * 12/1999 Kashiyama et al. ..... 439/157
6,045,375 A 4/2000 Aoki et al. ..... 439/157
6,077,100 A * 6/2000 Sakano ..... 439/57
6,142,826 A * 11/2000 Bourillon ..... 439/157
6,149,473 A * 11/2000 Lalange et al. ..... 439/157
6,155,850 A * 12/2000 Martin et al. ..... 439/157

FOREIGN PATENT DOCUMENTS

DE 19638368 4/1998

* cited by examiner

*Primary Examiner*—Brian Sircus
*Assistant Examiner*—Hae Moon Hyeon
(74) *Attorney, Agent, or Firm*—Stacey E. Caldwell

(57) ABSTRACT

An electrical connector assembly (1) includes first and second connectors (3, 4) each having a housing (7, 4) mounting a plurality of terminals mateable with the terminals of the other connector. A camming system (30 to 37, 39 to 44) is provided for moving the housings (7, 4) towards and away from each other along a mating axis (X) to mate and unmate the connectors. The camming system includes a lock slide (27) member which is mounted on one of the housings and which is slidably movable along a path (E). The lock slide member (27) includes a cam track (30 to 37) extending obliquely to the mating axis. The other housing (4) has a cam follower (41, 42) projecting into the cam track (34, 35) for mating the connectors in response to a movement of the lock slide (27) member. Mounting means (30 to 33, 39, 40, 43, 44) support said lock slide member (27) slidably movable along a path (E) extending transverse in a non-perpendicular direction to the mating axis (X).

18 Claims, 6 Drawing Sheets

ELECTRICAL CONNECTOR ASSEMBLY WITH IMPROVED CAMMING SYSTEM

FIELD OF THE INVENTION

This invention generally relates to the art of electrical connectors and, particularly, to a camming system for mating and unmating a pair of connectors.

BACKGROUND OF THE INVENTION

Mateable electrical connector assemblies generally include a pair of connectors having respective housings each mounting a plurality of terminals in respective terminal-receiving passages. Each connector housing defines a forward mating end and a rear end thereof. The terminals may be connected to individual wires of a multi-wire cable which extends away from the rear end of the connector. A cover or hood may be provided to enclose the rear end of the connector about the terminated end of the multi-wire cable.

Electrical connectors of the general type described above sometimes include some form of mechanism to assist in mating and unmating the connectors. This often is true with connector assemblies that mount a large number of terminals, and if the resulting mating and unmating forces are relatively large. In addition, such mechanisms often are employed to assure that the connectors are mated generally parallel to a mating axis and to avoid forcing the connectors together in a canted orientation which could damage the connectors and particularly the terminals thereof.

One type of mechanism for assisting in mating and unmating a pair of electrical connectors commonly is called a camming system. Slides and the like, are mounted on one of the connectors for cooperation with mechanisms on the other connector to define a cam track and cam follower arrangement which is effective to draw the connectors into mated condition and to assist in separating the connectors toward an unmated condition.

A camming system of the above described type is disclosed in U.S. Pat. No. 5,660,556 and in German laid open publication DE 196 38 368. According to the teaching of these documents a cam track is defined in a lock slide member slidably held on one of the connectors and a cam follower is formed on the other connector.

However, these and many other similar prior art camming systems rely on lock slide members held slidably in a direction perpendicular to the mating axis and a relative movement in mating direction is caused only between the first and the second connector housing. No relative movement is caused in mating direction between the lock slide member and the said one of the connector housings. Significantly, if space consumption of a connector assembly becomes a critical issue then prior art camming systems and especially the movement of both connectors relative to each other in these prior art arrangements often is not apt to cope with the actual requirements.

The present invention is directed to solving the problems of prior connector camming systems and providing an effective system for assisting in mating and unmating a pair of connectors.

SUMMARY OF THE INVENTION

An object, therefore, of the invention is to provide a new and improved mating and unmating camming system for an electrical connector assembly.

In an exemplary embodiment of the invention, the connector assembly includes a first and a second connector each having a housing mounting a plurality of terminals mateable with the terminals of the other connector, and a camming system for moving the housings toward and away from each other along a mating axis to mate and unmate the connectors. A lock slide member mounted on one of the housings includes a cam track and the other housing having a cam follower projecting into the cam track for mating the connectors in response to a sliding movement of the lock slide member. According to the invention mounting means mount the lock slide member on the first connector slidably movable along a path (E) extending transverse in a non-perpendicular direction relative to the mating axis. As a consequence thereof, moving of the lock slide member causes a displacement of the lock slide member relative to the first connector housing in mating and unmating direction adding to the total relative displacement caused by the cam track and cam follower arrangement.

Specifically, in a preferred embodiment of the invention the camming system includes an lock slide member which has at least two cam track and cam follower arrangements and both housings have cam followers projecting into the respective cam track for mating and unmating the connectors in response to a respective sliding movement of the lock slide member. According to this double action movement caused by both of the cam track and cam follower arrangements a smaller angle of inclination is used for each cam track arrangement resulting in reduced friction forces and causing less wear and a higher reliability of the arrangement. Moreover, a reduced angle of inclination further ameliorates the risk of unintended unmating due to vibrational forces or mechanical shocks.

In the preferred embodiment of the invention the lock slide member is a generally u-shaped integrally molded part, having two elongated arms extending in parallel on opposite sides of the one connector housing and defining two pairs of cam tracks in each elongated arm. One of both pairs of cam tracks defines at least two regions having a different angle inclination relative to each other. As a consequence thereof, the movement of both connector housings relative to each other in relation to the sliding movement of the lock slide member is well adapted to forces created by mating and unmating the terminals which ensures a user friendly low mating force operation.

Still further, in the disclosed embodiment, said cam tracks comprise an inwardly projecting rib and said cam followers comprise a distal radially extending rib avoiding a slipping of the cam followers out of the respective cam track.

Preferably, latch means operatively associated between the lock slide member and the one housing to define discrete unmated and mated positions for the lock slide member provide for a fail safe operation, even under the influence of increased vibrational forces or severe mechanical shocks. In detail, preferred latch means comprise an abutment boss abutting in the fully unmated position of the lock slide member a recess of a side wall of the one connector housing and securing the lock slide member in an unmated position.

In a further preferred embodiment, one of the connector housings comprises a terminal carrying element fixedly held on the one connector housing which mounts a first plurality of terminals. A modular terminal carrying insert which mounts a second plurality of terminals is adapted to be inserted into an associated opening of said one of the connector housings. In the mounted position, said terminal carrying modular insert is elastically held in said associated opening of said one connector housing and provides for an elastic lateral displacement relative to the fixedly mounted terminal carrying element during mating and unmating.

In the disclosed further preferred embodiment, said fixedly mounted element is an integral part of said one of the connector housings and carries a first plurality of terminals including a standard set of terminals and said modular element carries a second plurality of terminals comprising a customized set of terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
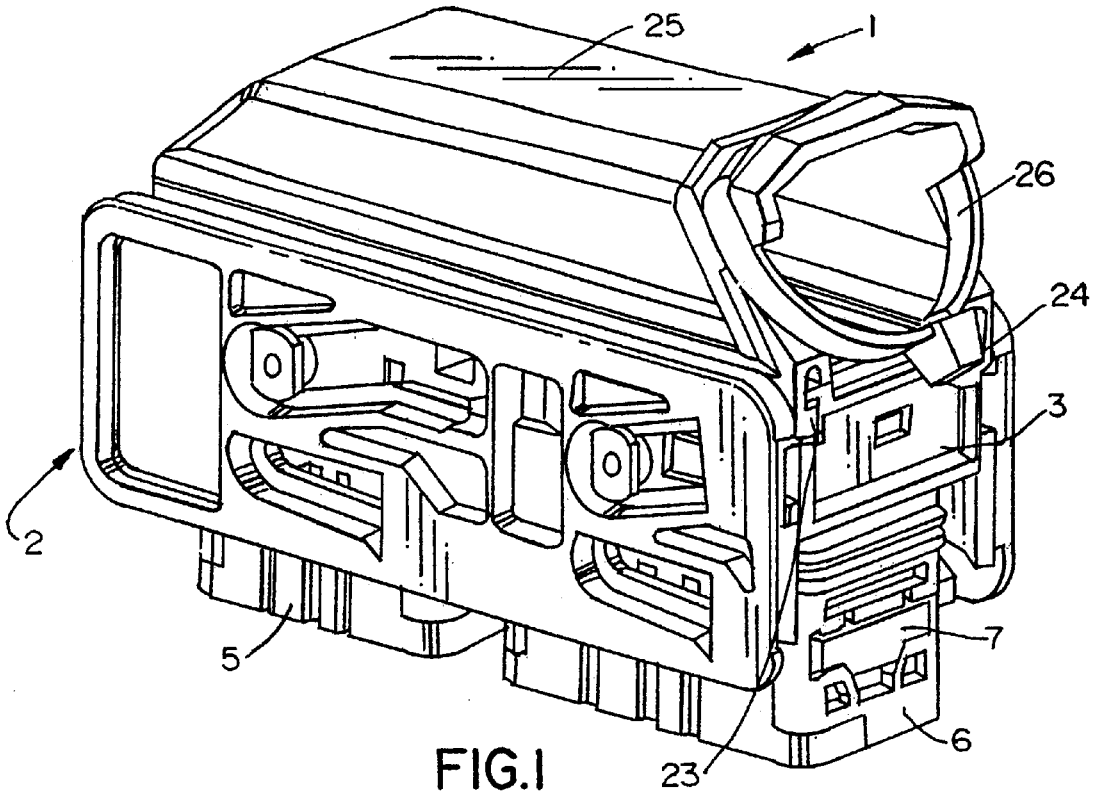
FIG. 1 is a perspective view of a hooded electrical connector assembly embodying the concepts of the invention showing a lock slide member in a closed or mated position and showing portions of a fixedly mounted terminal carrying element together with a modular terminal carrying insert.
Figure 2:
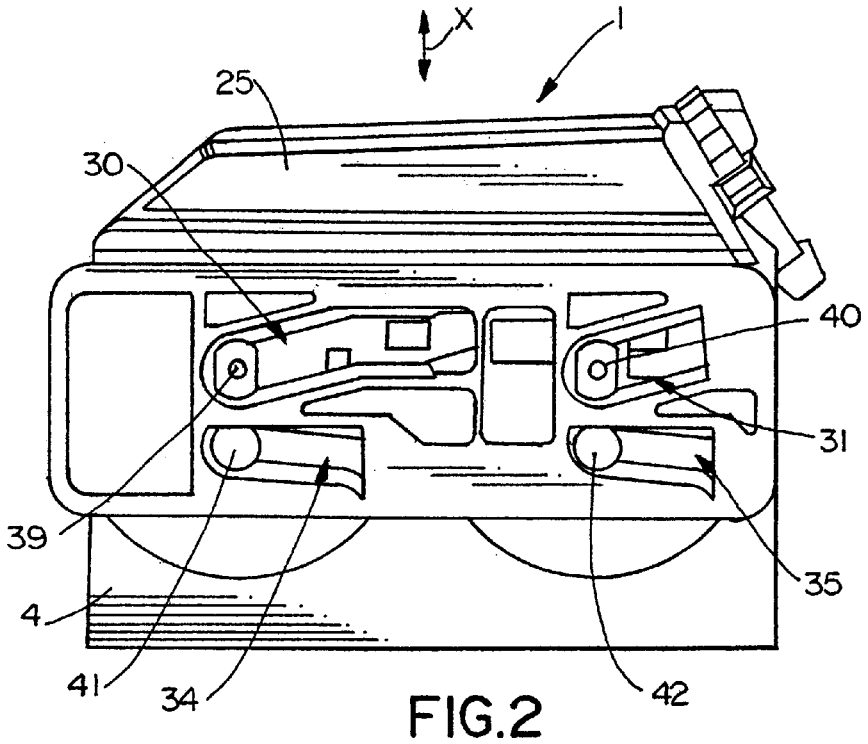
FIG. 2 is a side view of the hooded electrical connector assembly according to FIG. 1 along with a housing portion of a complementary mating connector.
Figure 3:
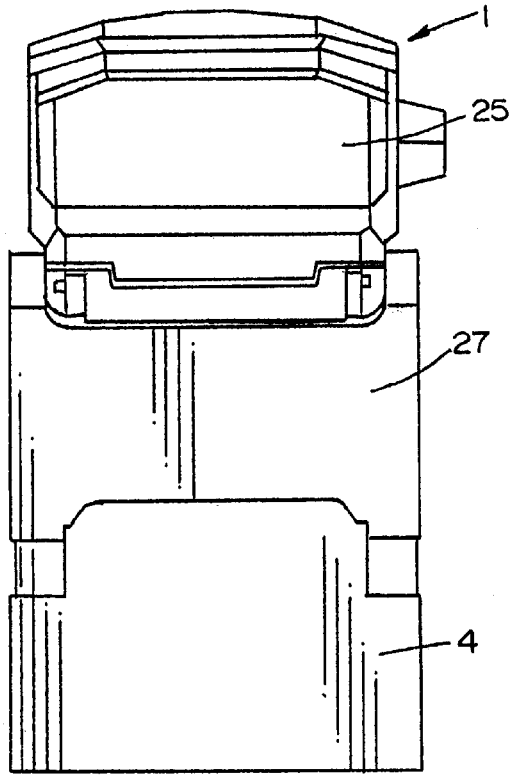
FIG. 3 is a is a front view of the hooded electrical connector assembly according to FIG. 1 along with the housing portion of the complementary mating connector shown in FIG. 2.
Figure 4:
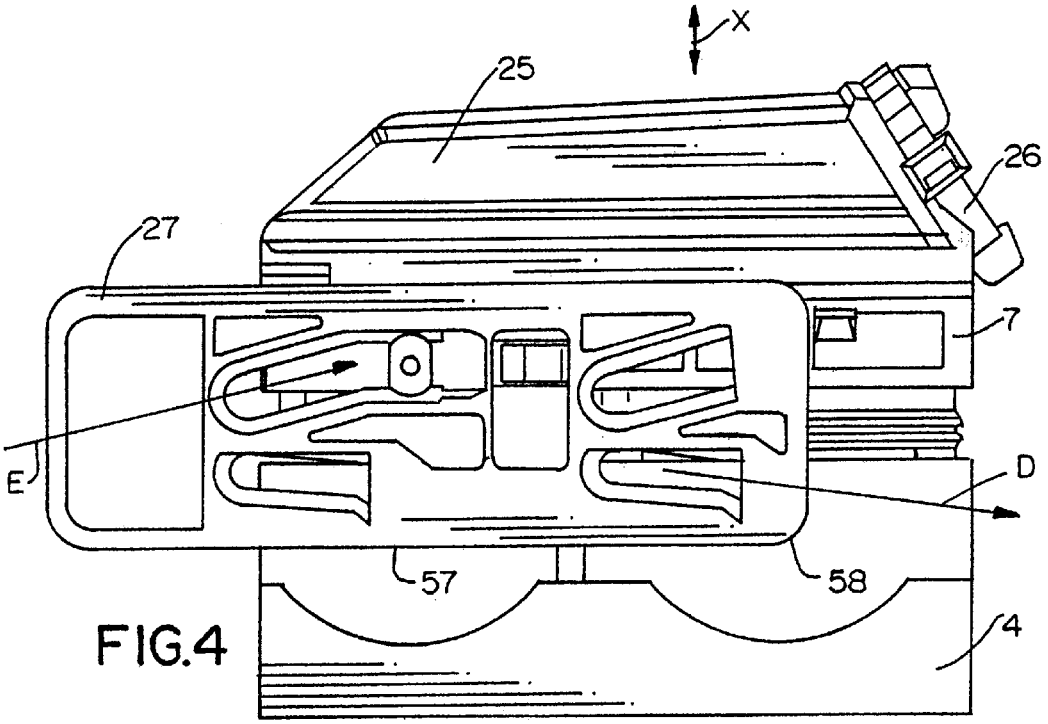
FIG. 4 is a side view of the hooded electrical connector assembly along with the housing portion of the complementary mating connector showing the lock slide member in its unmated position.
Figure 5:
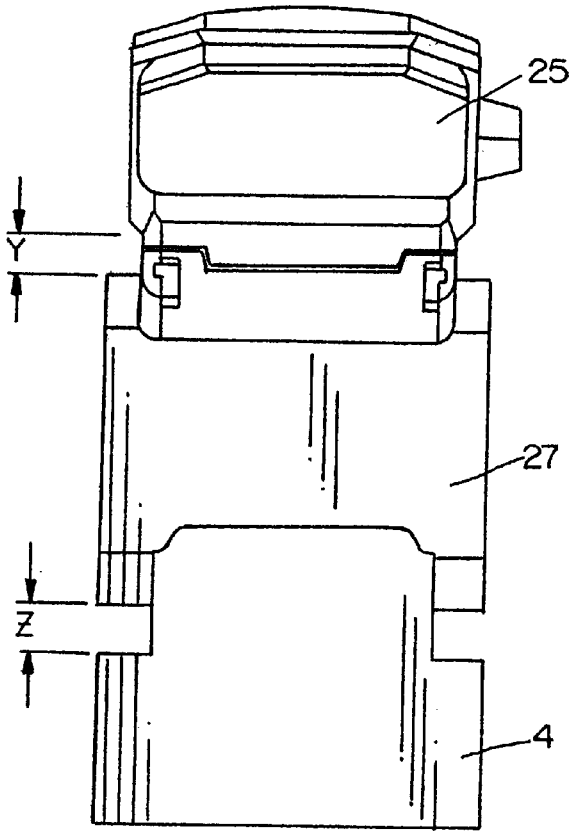
FIG. 5 is a view similar to that of FIG. 3, with the lock slide member in its unmated position.

Referring to the drawings in greater detail, and first to FIGS. 1 and 2, the invention is embodied in a hooded electrical connector assembly, generally designated 1, comprising a first and a second connector 3, 4 as well as a camming system 2 which is shown in its mated position in FIGS. 1, 2 and 3 and in its unmated position in FIGS. 4 and 5. The connectors define a mating axis "X" shown in FIG. 4 as double headed arrow.

For a better understanding, in FIG. 1, the first or upper connector 3 is shown without the second connector 4 to expose a terminal carrying modular insert 5 along with a fixedly mounted terminal carrying element 6 and is shown in FIGS. 2 to 5 in conjunction with a portion of the housing of the complementary mating second connector 4. The entirety of the mating second connector 4 is not shown in the drawings as second connector 4 is not restricted to multi-wire cable connectors but may be part of a housing of an electrical device such as an automotive control unit or the like.

A first plurality of terminals (not shown in the drawings) as used, for example, in the automotive industry for connecting different electrical standard devices of a car with a central control unit, is held in fixedly mounted element 6 by detent latch means 70 as is well known to a person skilled in the art of multi-wire cable connectors.

A second plurality of terminals (not shown in the drawings) is held in modular insert 5 and preferably includes one ore more customized sets of terminals as used, for example, in the automotive industry for special appliances. In a preferred embodiment 32 terminals are held in modular insert 5 and 48 terminals in fixedly mounted element 6, thus providing for an 80 terminal multi-wire connector.

Figure 7:
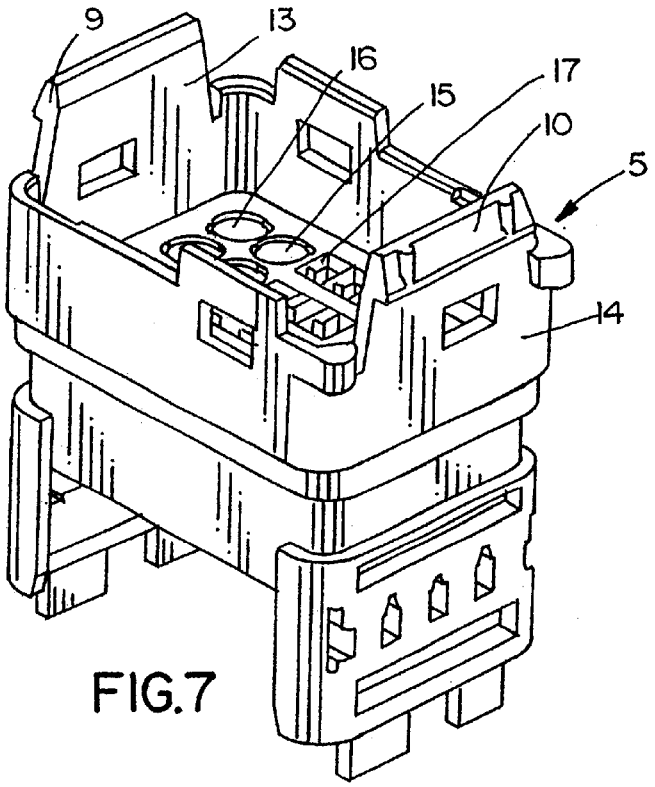
FIG. 7 is a perspective view of a terminal carrying modular insert adapted to be inserted into the associated opening of the connector housing portion shown in FIG. 6.

Generally and as may be best seen from FIG. 7, hooded electrical connector 3 includes housing means, generally designated 7, which define a receptacle or opening 8 for accommodating modular insert 5.

Figure 6:
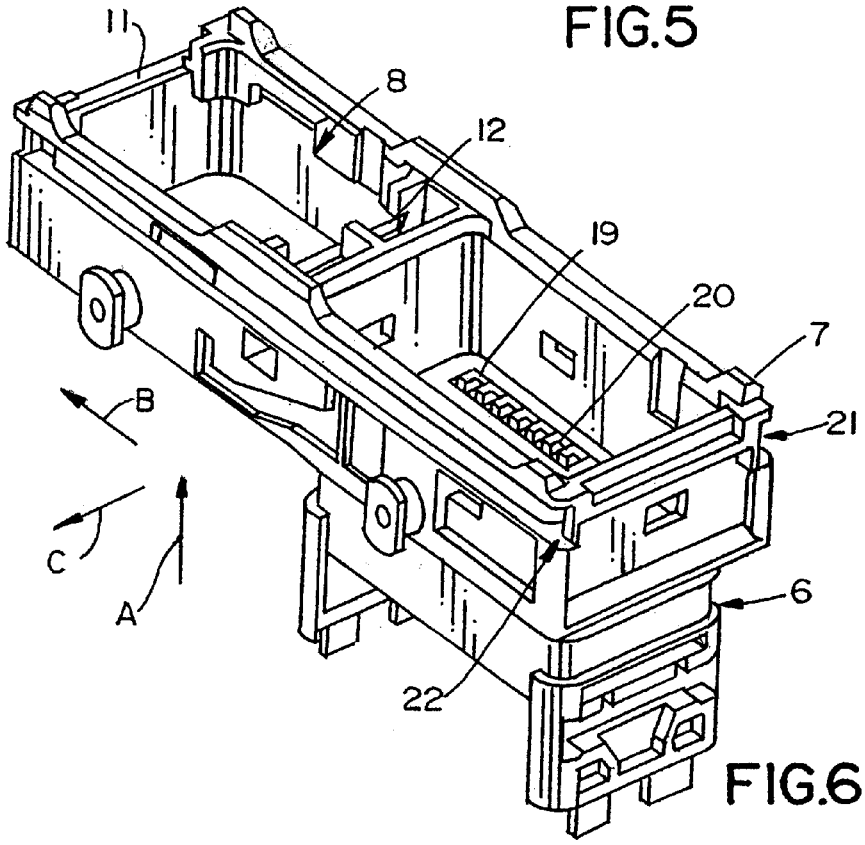
FIG. 6 is a perspective view of a housing portion of one of the electrical connectors with detached connector hood showing an opening associated with a modular terminal carrying insert and a fixedly mounted terminal carrying element.

Referring to FIGS. 6 and 7 in conjunction with FIG. 1, modular insert 5 has essentially wedge shaped lateral latch means 9, 10 snapping over shoulders 11, 12 of receptacle 8 and securing modular insert 5 within receptacle 8 if modular insert 5 is moved in direction of arrow "A" of FIG. 6 into receptacle 8.

In this floating mounted position modular insert 5 is, due to the elasticity of lateral latch arms 13, 14 which carry wedge-shaped latch means 9, 10, apt to flexibly move in the lateral direction relative to fixedly mounted element 6 indicated by arrow "B" of FIG. 6, thus adopting a wide range of tolerances of mating multi-wire connector 4. Between the inner side walls of opening 8 and lateral latch arms 13, 14 there is a lateral space allowing for a defined lateral movement of modular insert 5 relative to housing means 7 in advance of a flexible deformation of lateral latch arms 13, 14.

In a further preferred embodiment, frictional forces secure modular insert 5 within receptacle 8 in the lateral direction of arrow "C" of FIG. 6 but still allow for a self adjusting motion of floatably held insert 5 relative to housing means 7.

Terminal receiving cavities indicated by way of example based on numerals 15, 16, 17, 18, 19 are defined in modular insert 5 and in fixedly mounted element 6 adapted in its size and configuration to the respective terminal of a multi-wire-cable not shown in the drawings.

A pair of lateral grooves 21, 22 houses a pair of longitudinal ribs 23, 24 of connector hood 25 in the assembled position thereof as may be best seen from a combination of FIGS. 1 and 6. Further, a cable binder 26 is held on connector hood 25 and defines a strain relief means for a multi-wire cable.

Figure 11:
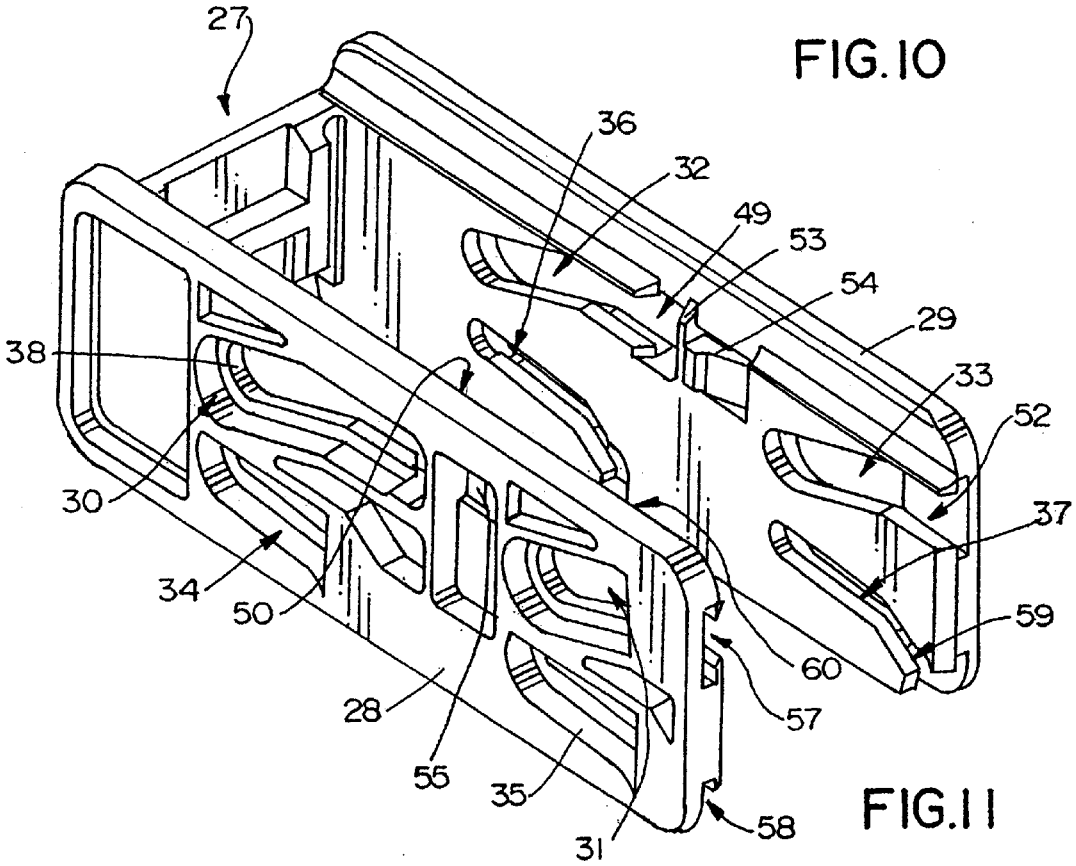
FIG. 11 is a perspective view of the lock slide member adapted to be slidably mounted on the connector housing portion shown in FIGS. 6 to 10.
Figure 12:
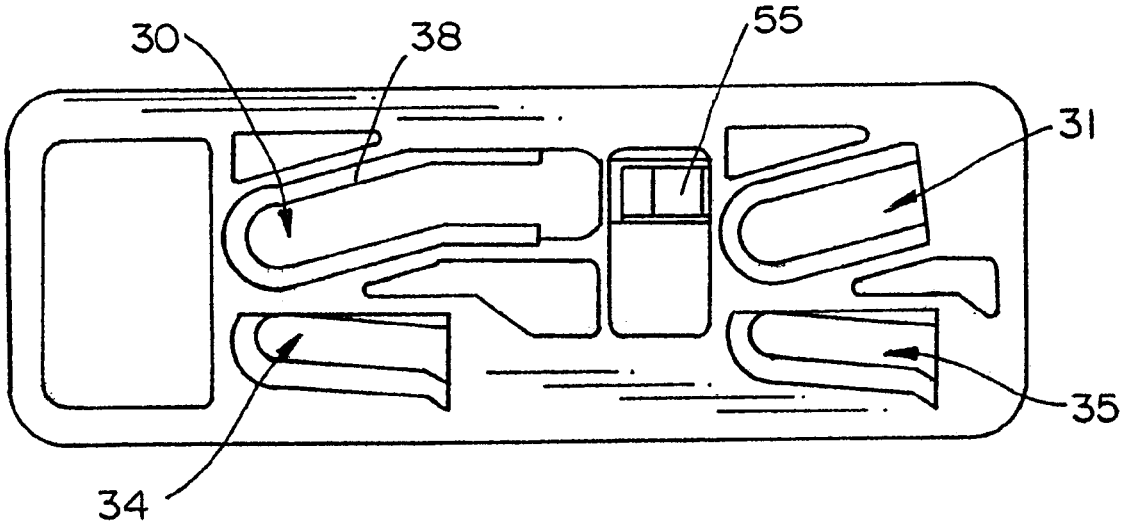
FIG. 12 is a side view of the lock slide member shown in FIG. 11.

Referring to FIGS. 1, 2 and 4 in conjunction with FIGS. 11 and 12, FIG. 11 shows a perspective view of essentially U-shaped lock member 27 being an integrally molded part and defining two elongated arms 28, 29 extending in parallel relative to each other.

Each elongate arm 28, 29 forms a first pair of cam tracks 30 to 33 and a second pair of cam tracks 34 to 37, these pairs of cam tracks define an angle of inclination relative to mating axis X as shown in FIG. 4 by arrows "E" and "D", respectively. Each cam track comprises an inwardly projecting rib 38 which is shown by means of example only in FIGS. 11 and 12 for cam track 30 and secures a respective cam follower 39 to 42 as shown e.g. in FIG. 2.

Figure 8:
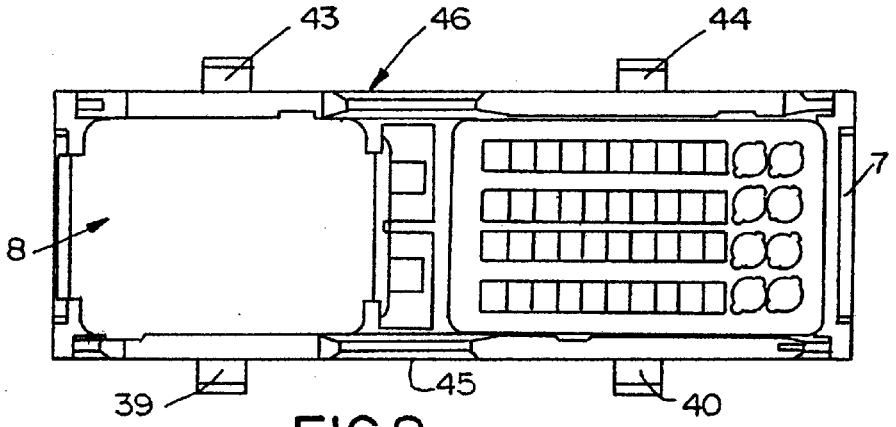
FIG. 8 is a top view of the housing portion of the one electrical connector shown in FIG. 6 with detached connector hood and without an inserted terminal carrying modular insert.
Figure 9:
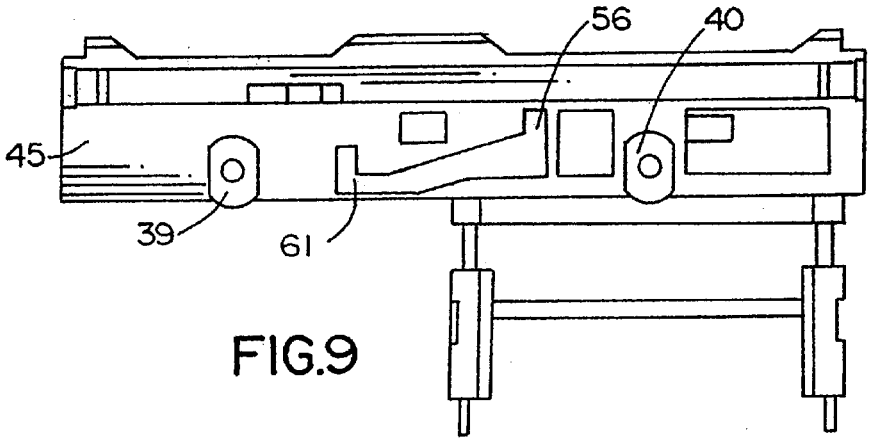
FIG. 9 is a side view of the housing portion of the one electrical connector shown in FIG. 8 with detached connector hood.
Figure 10:
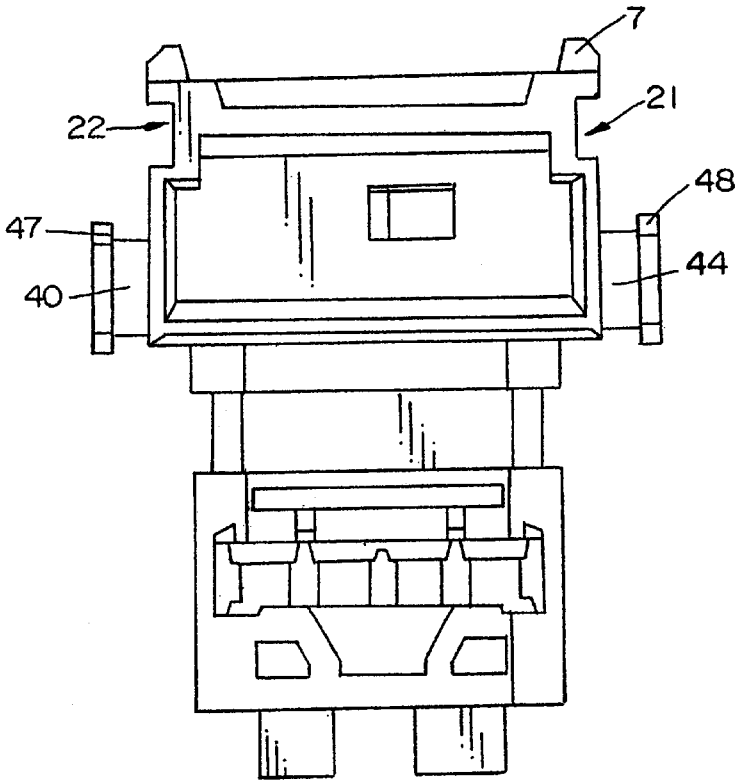
FIG. 10 is a front view of the housing portion of the one electrical connector shown in FIG. 8 with detached connector hood.

As may be seen in FIGS. 8 to 10, a first pair of cam followers 39, 40 and 43, 44 extend from both main side walls 45, 46 of housing means 7 of first connector 3. Each cam follower forms a distal laterally extending rib 47, 48 extending in an assembled position of lock slide member 27 behind the respective inwardly projecting ribs 38 of cam tracks 30 to 37.

For a better understanding, assembling of lock slide member 27 is described below by reference to FIGS. 4, 8, 9 and 11. In a first step, lock slide member 27 is positioned relative to housing means 7 in a way that cam followers 39, 43 enter access openings 49, 50 of cam tracks 30, 32 and, consequently cam followers 40, 44 are in the neighborhood of access openings 51, 52, of cam tracks 31, 33. Moving lock slide member in a direction opposite to arrow "B" of FIG. 6 introduces cam followers 40, 44 into cam tracks 31, 33 and latch means 53, 54, 55 begin to ride on the outside surface of side walls 45, 46 of housing means 7. Latch means 53, 54, 55 include wedge type inwardly projecting elastic elements 54, 55 and abutment means 53 riding during the further movement of lock slide member 27 on the side walls 45, 46 and enter recesses 56, which in the drawings are only shown for side wall 45, releasably latching lock slide member in its unmated position, i.e. in a position to be assumed in advance of mating both connectors 3, 4. Abutment means 53 shown in FIG. 11 abut the right hand side of recess 56, as best seen in FIG. 9 and protect from an unwanted unmounting of lock slide member 27.

In this unmated position of lock slide member 27 the first connector 3 can be placed onto the second connector 4 and assumes a premated position as shown in FIG. 4 where cam followers 41, 42, which only are seen in FIG. 2 in the mated position, are introduced into lower access openings 57, 58 and covered by lock slide member 27. In addition, access openings of elongate arm 29 accommodate the respective associated cam followers 43, 44, see FIGS. 8 and 11.

If lock slide member 27 is moved, first, further in a direction opposite to arrow "B" and subsequent in the direction of arrow "E" of FIG. 4, then a relative movement in mating direction (X) between lock slide member 27 and the upper connector 3 is generated causing a displacement "y" shown in FIG. 5. In addition, a further relative movement in mating direction (X) between said lock slide member 27 and the other connector 4 generating a displacement "z" results from a sliding of cam tracks 34, 35 relative to cam followers 41, 42 in the direction of arrow "D" of FIG. 4. As a consequence, a total displacement of $x=z^{*}+y$ is achieved by the camming system according to the invention.

In addition to the displacement in mating direction "X", a movement of lock slide member in the direction of arrow "E" moves latch elements 53 and 54 out of recess 56 and at the end of the mating movement into recess 61 of side wall 45.

In this position lock slide member 27 is releasably held in the mated position thereof which is shown in FIGS. 2 and 3.

If it is intended to unmate the hooded electrical connector assembly 1, lock slide member 27 has to be pushed against latching forces of latching means in the direction of arrow "E" of FIG. 4 and the relative movement of the cam followers relative to the cam tracks is reversed, leading from the mated position shown in FIGS. 2 and 3 to the unmated or premated position shown in FIG. 4. In this position the upper connector can be easily removed from the other connector 4.

It will be understood that the invention may be embodied in other specific forms without departing from the spirit or central characteristics thereof. For example, it lies within the scope of the invention to adopt different angles of inclination for the respective cam tracks and to use different angles of inclination along a respective cam track to optimize a relation between mating forces and displacement of the lock slide member.

We claim:

1. An electrical connector assembly comprising:

a first and a second connector (3, 4) each having a housing (7, 4) mounting a plurality of terminals mateable with the terminals of the other connector;

a camming system (27, 34 to 37, 41, 42) for moving the housings (7, 4) towards and away from each other along a mating axis (X) to mate and unmate the connectors (3, 4);

a lock slide member (27) mounted on one of the housings, the lock slide member (27) including a cam track (34 to 37) extending obliquely to the mating axis (X);

the other housing having a cam follower (41, 42) projecting into the cam track (34 to 37) for mating the connectors in response to a sliding movement of the lock slide member (27); and mounting means (30 to 33, 39, 40, 43, 44) for mounting said lock slide member (27) slidably movable along a path (E) extending transverse in a non-perpendicular direction to the mating axis (X).

2. The electrical connector assembly as set forth in claim 1, wherein said mounting means (30 to 33, 39, 40, 43, 44) for mounting said lock slide member (27) comprises a further cam track (30 to 33) extending obliquely to the mating axis (X), and said one of the housings includes a further cam follower (39, 40, 43, 44) projecting into the further cam track (30 to 33).

3. The electrical connector assembly as set forth in claim 1, wherein said lock slide member (27) is a generally u-shaped integrally molded part, having two elongated arms (28, 29) extending in parallel on opposite sides of the one connector housing.

4. The electrical connector assembly as set forth in claim 2, wherein one or both cam tracks (30 to 37) defines at least two regions having a different inclination relative to each other.

5. The electrical connector assembly as set forth in claim 2, wherein said cam tracks (30 to 37) comprise an inwardly projecting rib (38) and said cam followers comprise a distal radially extending rib (47, 48).

6. The electrical connector assembly as set forth in claim 1, further including latch means (53, 54) operatively associated between the lock slide member (27) and the one housing to define discrete unmated and mated positions for the lock slide member (27).

7. The electrical connector assembly as set forth in claim 6, wherein said latch means (53, 54) comprises an abutment boss (53) abutting a recess (61) of a side wall of said one connector housing in the fully unmated position of the lock slide member (27).

8. The electrical connector assembly as set forth in claim 6, wherein said latch means (53, 54) comprise a wedge type inwardly projecting elastic latching element (54).

9. A camming system for an electrical connector assembly which electrical connector assembly includes a first and a second connector (3, 4) each having a housing (7, 4) mounting a plurality of terminals mateable with the terminals of the other connector, said camming system (27, 34 to 37, 41, 42) adapted to move the housings (7, 4) towards and away from each other along a mating axis (X) to mate and unmate the connectors, the camming system comprising:

a lock slide member (27) mounted on one of the connector housings (7, 3), the lock slide member (27) including a cam track (34 to 37) extending obliquely to the mating axis (X);

a cam follower mounted (41, 42) on the other housing and projecting into the cam track (34 to 37) for mating the connectors in response to a sliding movement of the lock slide member (27); and mounting means (30 to 33, 39, 40, 43, 44) for mounting said lock slide member slidably movable along a path (E) extending transverse in a non-perpendicular direction to the mating axis (X).

10. The camming system as set forth in claim 9, wherein said mounting means (30 to 33, 39, 40, 43, 44) for mounting said lock slide member (27) comprises a further cam track (30 to 33) extending obliquely to the mating axis (X) and the said one of the housings having a further cam follower (39, 40, 43, 44) projecting into the further cam track.

11. The camming system as set forth in claim 10, wherein said lock slide member (27) is a generally u-shaped integrally molded part, having two elongated arms (28, 29) extending in parallel on opposite sides of the one connector housing and defining two pairs of cam tracks (30 to 37) in each of the elongated arms (28, 29).

12. The camming system as set forth in claim 11, wherein in response to slidably moving said lock slide member (27) in a direction transverse to said mating direction (X) the one pair of cam tracks (30 to 33) causes a relative movement in the mating direction (X) between said lock slide member (27) and said one connector housing, and wherein the other pair of cam tracks (34 to 37) causes a relative movement in the mating direction (X) between said lock slide member (27) and said other housing.

13. The camming system as set forth in claim 11, the one pair of cam tracks (30 to 33) comprises a first and a second cam track, said first cam track (30, 32) having an access opening accessible from the upside and said second cam track (31, 33) having an access opening accessible in a longitudinal direction of said elongated arm (28, 29).

14. The camming system as set forth in claim 9, including latch means (53, 54) operatively associated between the lock slide member (27) and the one housing to define discrete unmated and mated positions for the lock slide member (27).

15. The camming system as set forth in claim 14, wherein said latch means (53, 54) comprise an abutment boss (53) abutting onto a recess (61) of a side wall of said one connector housing in the fully unmated position of the lock slide member.

16. The camming system as set forth in claim 14 or 15, wherein said latch means (53, 54) comprises a wedge-type inwardly projecting elastic latching element (54).

17. A method for mounting a lock slide member to a connector housing including a lock slide member (27) having a generally u-shaped integrally molded body, and two elongated arms (28, 29) extending in parallel each having two pairs of cam tracks (30 to 37), one pair of cam tracks comprising a first and a second cam track, said first cam track (30, 32) having an access opening (49, 50) accessible from the upside and said second cam track having an access opening (51, 52) accessible in a longitudinal direction of said respective elongated arm (28, 29), said connector housing comprises a first and a second cam follower (39, 40, 43, 44) on each of the two lateral main housing walls thereof, the method comprising the steps of:

positioning said first cam follower (39, 43) in to the access (49, 50) opening of said first cam track (30, 32) from the upside in a direction transverse to the longitudinal direction of the arms, positioning said second cam follower (40, 44) in the neighborhood of the access opening (51, 52) of said second cam track (31, 32), moving said lock slide member (27) in the longitudinal direction of the arms (28, 29) thereof, and moving said second cam follower (40, 44) into the access opening (51, 52) of said second cam track (31, 32).

18. The method for mounting a lock slide member to a connector housing as set forth in claim 17, further comprising bringing associated latch means (53, 54, 61) on the lock slide member (27) and on the connector housing (7) into an interengagement, and moving said lock slide member (27) to an unmated position thereof.

* * * * *